US010585377B2

(12) United States Patent
Sanmonji

(10) Patent No.: US 10,585,377 B2
(45) Date of Patent: Mar. 10, 2020

(54) IMAGE FORMING APPARATUS WITH DETECTION OF VALUES RELATED TO RESISTANCE VALUES OF SHEETS BEING PROCESSED

(71) Applicant: Toshiba Tec Kabushiki Kaisha, Tokyo (JP)

(72) Inventor: Yoshinori Sanmonji, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/250,265

(22) Filed: Jan. 17, 2019

(65) Prior Publication Data

US 2019/0243290 A1 Aug. 8, 2019

(30) Foreign Application Priority Data

Feb. 5, 2018 (JP) ..... 2018-017982

(51) Int. Cl.
*G03G 15/16* (2006.01)
*G03G 15/00* (2006.01)

(52) U.S. Cl.
CPC ..... *G03G 15/1675* (2013.01); *G03G 15/5054* (2013.01)

(58) Field of Classification Search
CPC ..... G03G 15/1675; G03G 15/5054; G03G 15/5062; G03G 21/20; G03G 21/203
USPC ..... 399/44, 45, 49, 66, 81
See application file for complete search history.

(56) References Cited

U.S. PATENT DOCUMENTS 7,742,712 B2 * 6/2010 Izumi ..... G03G 15/1675 399/44
8,693,911 B2 * 4/2014 Watanabe et al. ..... G03G 15/1675 399/45
9,632,461 B2 * 4/2017 Sugiura et al. ..... G03G 21/20
9,977,399 B2 * 5/2018 Kobayashi ..... G03G 21/20

FOREIGN PATENT DOCUMENTS

JP 2002082496 A 3/2002

* cited by examiner

*Primary Examiner* — William J Royer
(74) *Attorney, Agent, or Firm* — Kim & Stewart LLP

(57) ABSTRACT

In one embodiment, the image forming apparatus has a transfer member, a detector, a display, a transfer bias power source circuit, a memory, a processor, and so on. The processor calculates a value indicating a resistance value of a sheet, based on a measurement value of a voltage value or a current value of the transfer member by the detector. Further, when the calculated value indicating the resistance value of the sheet is a value outside a range of an allowable range stored in the memory, the processor makes the display display a message to recommend adjustment of a transfer bias to be applied to the transfer member by the transfer bias power source circuit.

10 Claims, 5 Drawing Sheets

IMAGE FORMING APPARATUS WITH DETECTION OF VALUES RELATED TO RESISTANCE VALUES OF SHEETS BEING PROCESSED

CROSS-REFERENCE TO RELATED APPLICATION

This application is based upon and claims the benefit of priority from the prior Japanese Patent Application No. 2018-017982, filed on Feb. 5, 2018, the entire contents of which are incorporated herein by reference.

FIELD

Embodiments described herein relate generally to an image forming apparatus.

BACKGROUND

Conventionally, an image forming apparatus transfers a toner image from an image carrier to a sheet, using a transfer member such as a transfer roller. As control of this transfer, constant voltage control and constant current control are known. In the constant voltage control, a problem such as transfer current shortage due to excessively large resistance of the transfer member, or abnormal discharge and so on due to excessively small resistance of the transfer member caused by environmental resistance variation of the transfer member may be generated. In addition, in the constant current control, transfer failure due to current shortage may be generated, by a leakage current from a place where the image carrier is in contact with the transfer member. In order to solve these problems, there is a system which applies a transfer voltage so that a proper transfer current is obtained, in accordance with a resistance value of the transfer member detected in a state in which a sheet is not present at a transfer position. In this system, the transfer voltage is corrected in accordance with the resistance value of the sheet which has been previously set for each kind of the sheet.

However, since the previously set resistance value (the setting resistance value) of the sheet is just an estimate value, a resistance value of an actual sheet can be greatly different from the setting resistance value. If the resistance value of the actual sheet is different from the setting resistance value, unmatching is generated between a transfer voltage to be set in accordance with the setting resistance value and a transfer voltage suitable for the resistance value of the actual sheet, in the transfer control. For the reason, there is a possibility that shortage of the transfer current or excess of the transfer current is generated to cause a defect. On the other hand, in a conventional image forming apparatus, it is necessary for a serviceman to manually perform setting of transfer control, and thereby it is difficult for a user oneself to change setting of a setting resistance value of a sheet and so on.

DETAILED DESCRIPTION

According to one embodiment, an image forming apparatus transfers a toner image to a sheet to form an image on the sheet of every kind. The image forming apparatus has an image carrier, a transfer member, a transfer bias power source circuit, a detector, a memory, a display, and a processor. The image carrier holds the toner image to be transferred to the sheet. The transfer member is provided opposite to the image carrier at a prescribed transfer position, and is applied with a transfer bias in accordance with a kind of the sheet. The transfer member is applied with the transfer bias to transfer the toner image from the image carrier to the sheet passing through the transfer position. The transfer bias power source circuit applies the transfer bias for transferring the toner image from the image carrier to the sheet to the transfer member. The detector measures a voltage value or a current value in the transfer member so as to calculate a value indicating a resistance value of the sheet passing through the transfer position. The memory stores information of an allowable range of the value indicating the resistance value of the sheet to be calculated based on a measurement value by the detector. The display displays a message to recommend adjustment of the transfer bias (a setting value of the transfer bias) to be applied to the transfer member by the transfer bias power source circuit. The processor calculates the value indicating the resistance value of the sheet based on the measurement value by the detector. The processor judges whether or not the calculated value indicating the resistance value of the sheet is a value outside a range of the allowable range stored in the memory. Further, the processor makes the display display the message when the calculated value indicating the resistance value of the sheet is the value outside the range of the allowable range stored in the memory.

Figure 1:
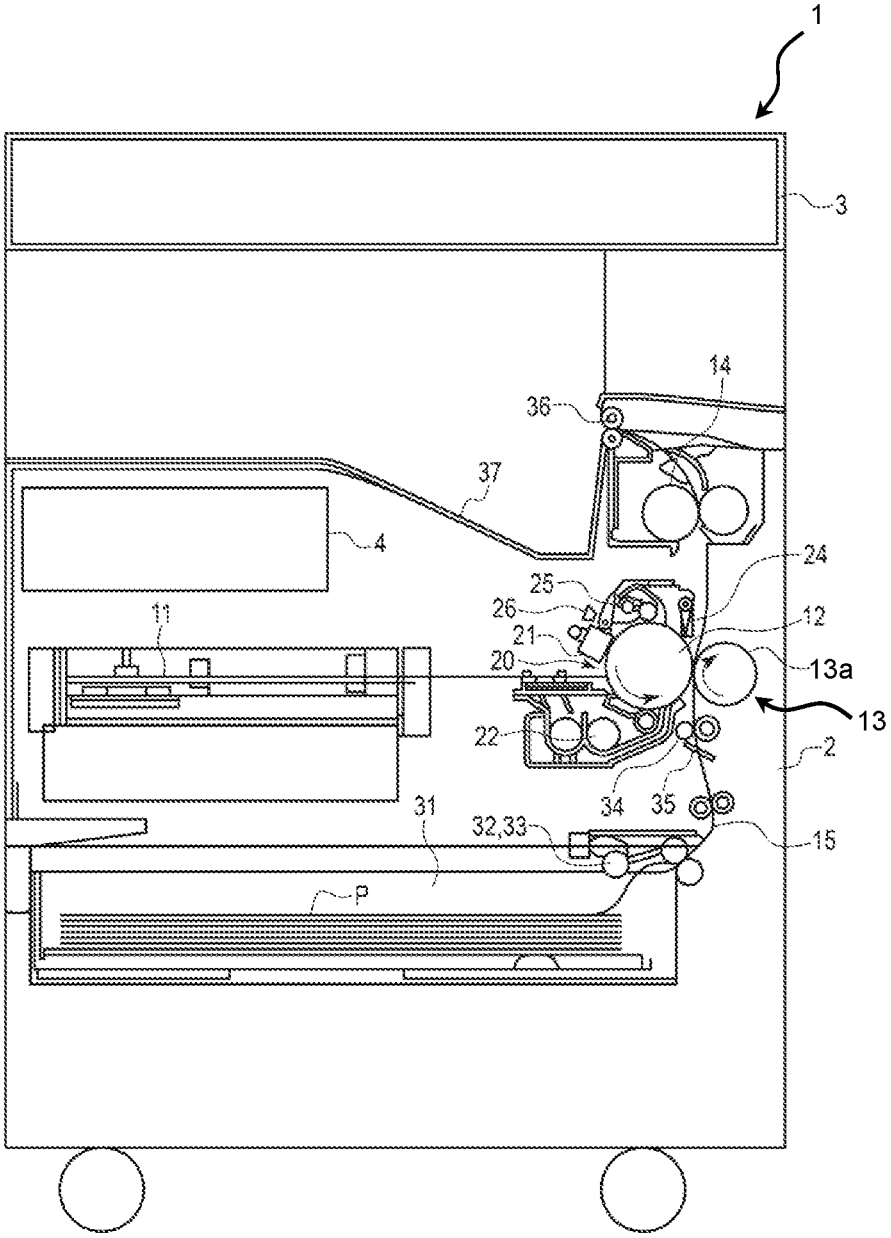
FIG. 1 is a sectional view showing a digital composite machine according to an embodiment.

Hereinafter, an embodiment will be described with reference to the drawings. In the drawings, the same symbols indicate the same or the similar portions. FIG. 1 is a sectional view schematically showing a configuration of a digital composite machine (MFP) 1 as an image forming apparatus according to an embodiment. As shown in FIG. 1, the digital composite machine 1 has a printer 2, a scanner 3, and a system controller 4. The printer 2 is a device to print an image on a sheet as a recording medium. The printer 2 of the digital composite machine 1 according to the embodiment forms an image by an electrophotographic system. The scanner 3 is a device to read an image of a document. The scanner 3 optically reads the image of the document to output image data.

The system controller 4 controls respective portions in the digital composite machine 1. The system controller 4 has a processor 41 (refer to FIG. 2). The processor 41 executes a program, and thereby the system controller 4 realizes various processings. For example, when the digital composite machine 1 copies an image of a document on a sheet, the system controller 4 makes the scanner 3 read the image of the document and output image data in accordance with the image of the document. The system controller 4 makes the printer 2 print the image of the document on the sheet based on the image data. In addition, the digital composite machine 1 has an operation panel 5 (refer to FIG. 2). The operation panel 5 is a user interface. The operation panel 5 displays an operation guide, for example. The operation panel 5 inputs an operation instruction by a user, for example.

Figure 2:
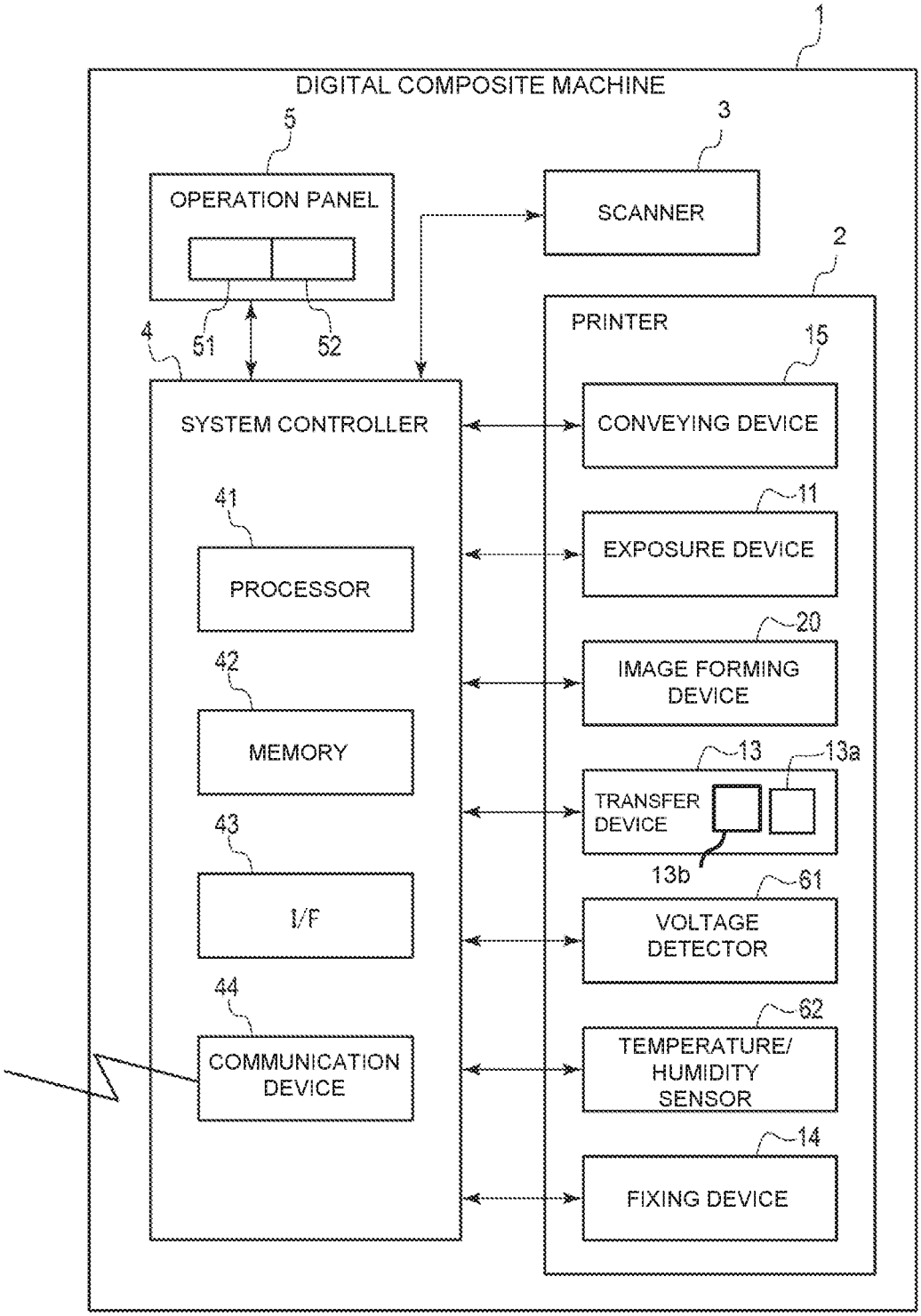
FIG. 2 is a block diagram showing a control configuration of the digital composite machine according to the embodiment.

Hereinafter, a configuration of the printer 2 will be described. As shown in FIG. 1 and FIG. 2, the printer 2 has an exposure device 11, a photoreceptor drum (image carrier) 12, an image forming device 20, a transfer device 13, a fixing device 14, a conveying device 15, and so on. The exposure device 11 forms an electrostatic latent image on the photoreceptor drum 12 as the image carrier. For example, the exposure device 11 has a light emitter and an optical system such as a polygon mirror. The light emitter generates laser light. The polygon mirror scans on the photoreceptor drum 12 with the laser light.

The photoreceptor drum 12 is an image carrier on which a toner image is formed. For example, the photoreceptor drum 12 is a cylindrical drum which is rotatably provided. The photoreceptor drum 12 is exposed with the laser light from the exposure device 11, and thereby an electrostatic latent image is formed on a circumferential surface thereof. That is, the exposure device 11 scans on the circumferential surface of the photoreceptor drum 12 with the laser light in accordance with the image data. By this means, an electrostatic latent image in accordance with desired image data is formed on the circumferential surface of the photoreceptor drum 12.

The image forming device 20 has an electrostatic charger 21, a developing device 22, a peeler 24, a cleaner 25, an eliminator 26, and so on which are provided in the vicinity of the circumferential surface of the photoreceptor drum 12.

The electrostatic charger 21 charges the circumferential surface of the photoreceptor drum 12 to a prescribed potential. The electrostatic charger 21 is arranged at the circumferential surface of the photoreceptor drum 12 so that the charged area is irradiated with the laser light from the exposure device 11. That is, on the circumferential surface of the photoreceptor drum 12, the area charged by the electrostatic charger 21 is irradiated with the laser light from the exposure device 11, and thereby an electrostatic latent image is formed on the charged area. The developing device 22 supplies toner as developing agent on the circumferential surface of the photoreceptor drum 12 formed with the electrostatic latent image to develop the electrostatic latent image. By this means, a toner image is formed on the circumferential surface of the photoreceptor drum 12.

The transfer device 13 has a transfer roller 13*a* and a transfer bias power source circuit 13*b*. The transfer roller 13*a* is arranged opposite to the photoreceptor drum 12 at a transfer position for transferring the toner image on the circumferential surface of the photoreceptor drum 12 to a sheet P. The transfer roller 13*a* is rotated along with the photoreceptor drum 12 to make the sheet P pass through the transfer position. The transfer roller 13*a* transfers the toner image formed on the circumferential surface of the photoreceptor drum 12 from the photoreceptor drum 12 to the sheet P passing through the transfer position. The transfer bias power source circuit 13*b* applies a transfer bias to the transfer roller 13*a* so as to transfer the above-described toner image. The details about the transfer roller 13*a* and the transfer bias power source circuit 13*b* will be described later.

The peeler 24 peels the sheet P which has passed through the transfer position from the photoreceptor drum 12. The peeler 24 has a peeling charger, a peeling claw, and so on. The cleaner 25 removes toner remaining on the circumferential surface of the photoreceptor drum 12 after transfer to clean the photoreceptor drum 12. The eliminator 26 eliminates the circumferential surface of the photoreceptor drum 12 after cleaning. The circumferential surface of the photoreceptor drum 12 returns to a position opposite to the electrostatic charger 21 again, in the state in which the remaining toner is removed and eliminated by the cleaner 25 and the eliminator 26.

The transfer roller 13*a* is rotatably provided at the transfer position opposite to the circumferential surface of the photoreceptor drum 12. The transfer roller 13*a* is in contact with the circumferential surface of the photoreceptor drum 12 when the sheet P does not pass through the transfer position. The transfer roller 13*a* conveys the sheet P while sandwiching the sheet P with the photoreceptor drum 12 when the sheet P passes through the transfer position. The transfer bias power source circuit 13*b* applies a transfer bias to the transfer roller 13*a* so as to form a transfer electric field between the transfer roller 13*a* and the photoreceptor drum 12. The transfer bias power source circuit 13*b* outputs the transfer bias under constant current control or constant voltage control to control the transfer electric field between the transfer roller 13*a* and the photoreceptor drum 12 at the transfer position. The toner is transferred from the circumferential surface of the photoreceptor drum 12 to the sheet P passing between the transfer roller 13*a* and the photoreceptor drum 12 (transfer position), by the transfer electric field.

In addition, the printer 2 has a detector (voltage detector) 61 (refer to FIG. 2), a temperature/humidity sensor 62 (refer to FIG. 2), and so on, as sensors used for the above-described transfer control. The detector 61 is a voltage detector to detect a voltage value between the transfer roller 13*a* and the photoreceptor drum 12 at the transfer position. Specifically, the photoreceptor drum 12 is at 0 v, for example, the detector 61 detects a voltage value of the transfer roller 13*a*. The temperature/humidity sensor 62 detects a temperature and a humidity as use environment of the digital composite machine 1. For example, when the transfer bias power source circuit 13*b* outputs a transfer bias (current value) under the constant current control, a voltage value which the detector 61 detects becomes a value indicating a resistance value between the transfer roller 13*a* and the photoreceptor drum 12 at the transfer position. In addition, when the transfer bias power source circuit 13*b* outputs a transfer bias (voltage value) under the constant voltage control, the printer 2 may have a current detector to detect a current value between the transfer roller 1*a* and the photoreceptor drum 12 at the transfer position, in place of the detector 61.

In addition, the conveying device 15 has, in the printer 2, a conveying path from a cassette 31 shown in FIG. 1 to the fixing device 14 through the transfer position, a plurality of conveying rollers, and so on. The conveying device 15 conveys the sheet P via the conveying path. The printer 2 has the cassette 31 to house the sheet P. A sheet feeding roller 32 and a separation roller 33 are provided in the vicinity of the cassette 31. The sheet feeding roller 32 and the separation roller 33 take out a sheet P from the cassette 31 one by one, and send out the sheet P to the conveying path of the conveying device 15. The conveying device 15 conveys the sheet P which has been taken out from the cassette 31 by the sheet feeding roller 32 and the separation roller 33 to a resist roller 34.

The resist roller 34 is arranged in front of the transfer position where the photoreceptor drum 12 is opposite to the transfer roller 13*a*. The resist roller 34 conveys the sheet P to the transfer position while correcting a tilt of the sheet P. In addition, a pre-aligning sensor 35 to detect arrival of the sheet P is arranged in front of the resist roller 34, in the conveying direction of the sheet P. The resist roller 34 conveys the sheet P to the transfer position, at a timing when a tip of the sheet P detected by the pre-aligning sensor 35 matches with a tip of the toner image formed on the circumferential surface of the photoreceptor drum 12. In addition, the resist roller 34 conveys the sheet P to the transfer position at the same speed as the movement speed of the circumferential surface of the photoreceptor drum 12.

The toner image (development agent image) formed on the circumferential surface of the photoreceptor drum 12 is transferred onto the sheet P at the transfer position, by an action of the transfer roller 13*a* applied with the transfer bias by the transfer bias power source circuit 13*b*. The sheet P to which the toner image has been transferred is peeled from the circumferential surface of the photoreceptor drum 12 by the peeler 24. The sheet P peeled from the circumferential surface of the photoreceptor drum 12 is conveyed to the fixing device 14 via the conveying path composing a part of the conveying device 15. The fixing device 14 performs a fixing processing in which the sheet P to which the toner image has been transferred is heated to fix the toner image to the sheet P. The sheet P subjected to the fixing processing by the fixing device 14 is discharged to a sheet discharge tray 37 by a sheet discharge roller 36.

Next, a configuration example of a control system in the digital composite machine 1 will be described. FIG. 2 is a block diagram showing a configuration example of a control system of the digital composite machine 1. In the digital composite machine 1, the system controller 4 is connected to respective portions such as the printer 2, the scanner 3, the operation panel 5, and so on via an interface (I/F) 43. By this means, the system controller 4 totally controls the respective portions such as the printer 2, the scanner 3, the operation panel 5, and so on.

As shown in FIG. 2, the system controller 4 has the processor 41, a memory 42, the interface (I/F) 43, a communication device 44, and so on. The processor 41 is a CPU (Central Processing Unit), for example. The processor 41 executes a program stored in the memory 42 to execute various processings. The processor 41 is connected to the respective portions in the printer 2, the scanner 3, the operation panel 5, and so on, via the interface 43. The processor 41 executes the program to control the respective portions.

The memory 42 includes a program memory, a work memory, a data memory, and so on. The program memory is a memory to store the program which the processor 41 executes. As the program memory, a nonvolatile memory such as a ROM, an NVM, an HDD, an SSD, and so on is used, for example. The work memory is a memory to store data for operation, and so on. As the work memory, a rewritable memory such as a RAM is used, for example. The data memory is a memory to hold various data. As the data memory, a rewritable nonvolatile memory such as an HDD, an SSD, and so on is used, for example. And the above-described memory 42 stores a table of information indicating an allowable range described later, for example. The processor 41 of the system controller 4 performs a judgement processing of ACT14 described later and an adjustment of the setting value of the transfer bias of ACT22 described later, with reference to the allowable range stored in the memory 42. In addition, the memory 42 stores a setting value of a transfer bias, for each of various sheets, for example. The setting value of the transfer bias is a value in accordance with a standard resistance value which each of the various sheets has, for example. The standard resistance value mentioned here is a resistance value of the sheet which has been measured under the environment of prescribed temperature/humidity, for example. The processor 41 reads out the setting value of the transfer bias stored in the memory 42, and controls the transfer bias power source circuit 13*b*, so that the transfer bias power source circuit 13*b* outputs the above-described read setting value of the transfer bias, as described later. In the present embodiment, the memory 42 stores, as the setting value of the transfer bias, a current value to be used when the transfer bias power source circuit 13*b* is switched to a constant current control state, and a voltage value to be used when the transfer bias power source circuit 13*b* is switched to a constant voltage control state, for example.

The interface 43 is an internal interface so as to connect between the respective portions in the digital composite machine 1. For example, the processor 41 of the system controller 4 connects to the respective portions via the interface 43. The communication device 44 includes a communication interface so as to communicate with an external device. For example, the communication device 44 includes a network interface, such as a LAN interface, so as to connect to a network. In addition, the communication device 44 may include an interface for radio communication. In addition, the communication device 44 may include a serial interface to serially communicate with an external device.

In addition, the operation panel 5 has a display device 51 and an operation device 52. For example, the operation panel 5 has a display with a touch panel, as the display device 51. In addition, the operation panel 5 has an operation button and so on, for example, as the operation device 52. The system controller 4 controls a guide, a GUI (Graphical User Interface), and so on which are to be displayed on the display device 51. In addition, the system controller 4 acquires information inputted by a user by means of the GUI, the operation button, or the like, as an operation portion of the operation panel 5.

In addition, the system controller 4 is connected to the respective portions in the printer 2. Specifically, in the configuration example shown in FIG. 2, the system controller 4 is connected to the respective portions in the printer 2, such as the exposure device 11, the image forming device 20, the transfer device 13, the fixing device 14, the conveying device 15, the detector 61, the temperature/humidity sensor 62, and so on. The system controller 4 controls the respective portion such as the exposure device 11, the image forming device 20, the transfer device 13, the fixing device 14, the conveying device 15, and so on to control an operation of the printer 2.

The system controller 4 controls a drive motor to drive the conveying roller and so on in the conveying device 15 to control conveyance of a sheet P. In addition, the system controller 4 controls a resist motor to rotate the resist roller 34 to control conveyance of the sheet P to the transfer position.

The system controller 4 controls operations of the respective portions (the photoreceptor drum 12, the electrostatic charger 21, the developing device 22, the peeler 24, the cleaner 25, and the eliminator 26) in the image forming device 20 to control formation of a toner image. For example, the system controller 4 controls the exposure device 11 in accordance with the above-described image data, so as to form an electrostatic latent image on the circumferential surface of the photoreceptor drum 12 which has been charged by the electrostatic charger 21. The system controller 4 controls the developing device 22 so as to develop the electrostatic latent image formed on the circumferential surface of the photoreceptor drum 12 by the developing device 22 to form a toner image. That is, the system controller 4 controls the respective portions of the image forming device 20 and the exposure device 11 in cooperation to form a toner image on the circumferential surface of the photoreceptor drum 12.

In addition, the system controller 4 makes the transfer roller 13*a* and the photoreceptor drum 12 to be rotated, and applies a transfer bias to the transfer roller 13*a* using the transfer bias power source circuit 13*b*. The system controller 4 makes the transfer bias power source circuit 13*b* output the transfer bias under constant voltage control or constant current control to control a transfer electric field at the transfer position. The system controller 4 makes the transfer bias power source circuit 13*b* to be selectively connected to any of a constant voltage power source or a constant current power source, for example, to switch the constant voltage control or the constant current control. For example, in the case of the constant voltage control, the system controller 4 makes the transfer bias power source circuit 13*b* output a transfer bias of a voltage value to be determined in accordance with a resistance value of a sheet and apply the transfer bias to the transfer roller 13*a*. For example, in the normal print processing, the system controller 4 determines a transfer bias to be applied to the transfer roller 13*a*, based on a voltage value in accordance with a resistance value of a sheet of a kind to be used in the print processing, which has been selected from the voltage values (the setting values of the transfer bias which are previously stored in the memory 42) in accordance with the resistance values of the previously set various sheets (plain paper and so on, for example).

In addition, the system controller 4 makes the resist roller 34 operate in accordance with the position of the toner image on the circumferential surface of the photoreceptor drum 12 to supply the sheet P to the transfer position. When the sheet P passes through the transfer position where the transfer bias is applied to the transfer roller 13*a*, the toner image is transferred from the photoreceptor drum 12 to the sheet P. The system controller 4 controls the conveying device 15 to further convey the sheet P (the sheet P to which the toner image has been transferred) which has passed through the transfer position to the fixing device 14.

The system controller 4 controls the fixing device 14. For example, the fixing device 14 has fixing members such as a fixing roller, a fixing belt, and so on, and a pressure member such as a pressure roller. The system controller 4 monitors a temperature of the fixing member of the fixing device 14 by a temperature sensor, to control so that a temperature of the fixing member becomes a fixing temperature. The system controller 4 controls the temperature of the fixing member to become the fixing temperature, and heats the sheet P, and pressurizes the sheet P by the pressure member to fix the toner image to the sheet P. In addition, the system controller 4 makes the sheet discharge roller 36 to be rotated to discharge the sheet P subjected to the fixing processing by the fixing device 14 to the sheet discharge tray 37.

Figure 3:
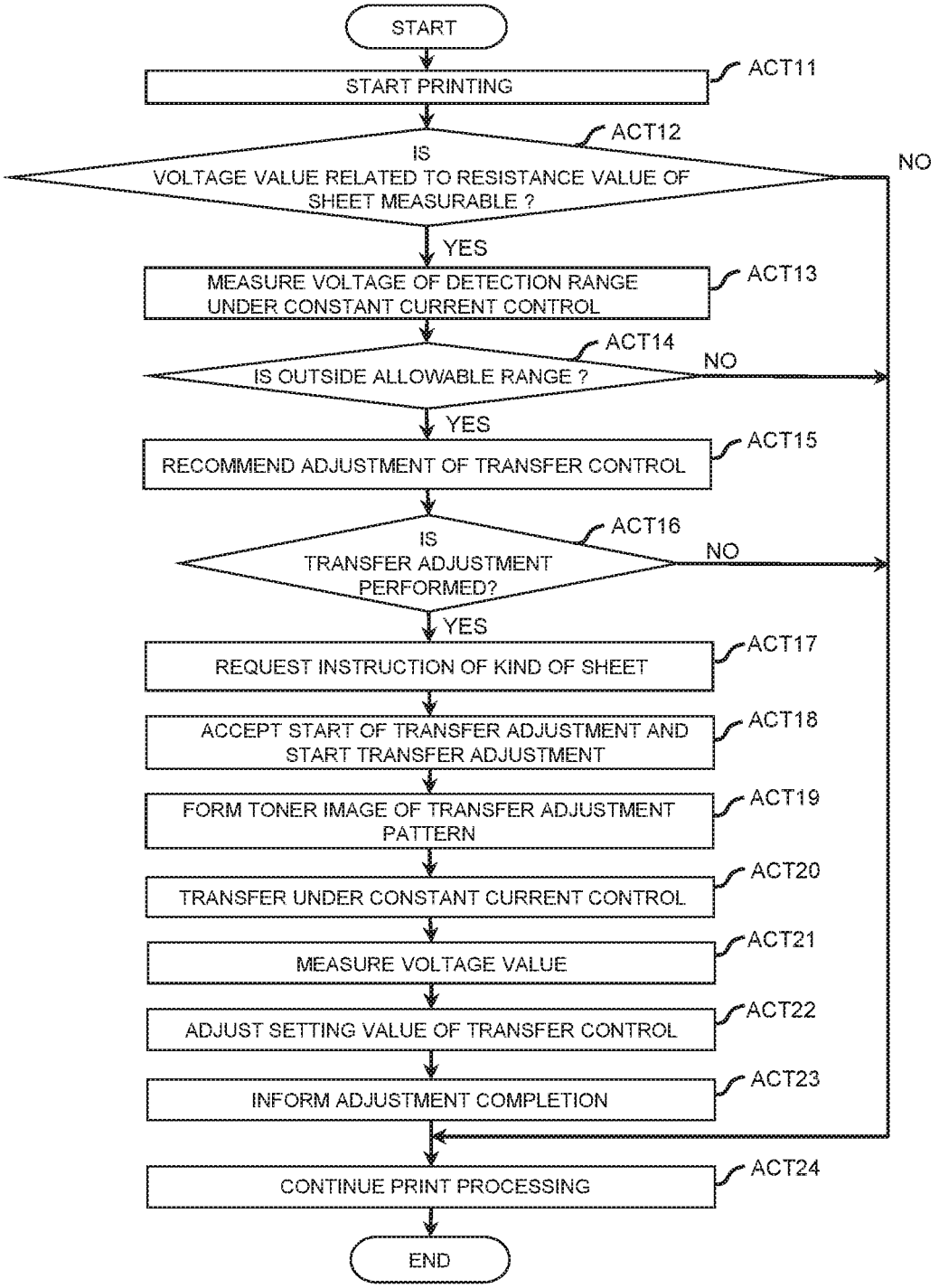
FIG. 3 is a flow chart showing a print processing by the digital composite machine according to the embodiment.

Next, a control processing related to transfer of a toner image in the digital composite machine 1 configured as described above will be described. In addition, a control processing described below is an example, and the embodiment is not limited to the control processing described below. To begin with, a control processing after a power source is turned on in the digital composite machine 1 until the digital composite machine 1 becomes a printable state will be described. When the power source is turned on, the processor 41 of the system controller 4 starts up the respective portions of the digital composite machine 1, and previously switches the transfer bias power source circuit 13*b* into a constant current control state, so as to measure a voltage value B to be used in a processing related to transfer adjustment described later. For example, the processor 41 reads the current value as the setting value of the transfer bias in accordance with the kind of the previously set standard sheet (for example, plain paper of A4 size with high usage frequency), and a humidity detected by the temperature/humidity sensor 62, from the memory 42. The processor 41 controls the transfer bias power source circuit 13*b* so that the transfer bias power source circuit 13*b* outputs the above-described read current value as the setting value of the transfer bias under the constant current control. The transfer bias power source circuit 13*b* applies the above-described read current value as the setting value of the transfer bias to the transfer roller 13*a*. The detector 61 measures the above-described voltage value B (the potential difference between the photoreceptor drum 12 and the transfer roller 13*a*) in the transfer roller 13*a*, in the state in which the above-described read current value as the setting value of the transfer bias is applied to the transfer roller 13*a*. That is, the voltage value B in the transfer roller 13*a* in the case in which a sheet is not present at the transfer position (between the photoreceptor drum 12 and the transfer roller 13*a*) is measured. The processor 41 makes the memory 42 primarily store the voltage value B measured by the detector 61, so as to obtain a value (a voltage value C) described later indicating a resistance value of the sheet. In addition, the measurement of the voltage value B may be performed at any time without being limited to the above-described case, when a sheet is not present at the transfer position. Next, a control processing in the printable state, and a control processing in a normal print processing to be executed in accordance with a print start instruction by a user will be described. In addition, the normal print processing described here is a print processing of ACT24 in the case of "NO" in ACT12 described later, for example. And the normal print processing is different from a print processing to be performed in parallel with processings of ACT12 to ACT15 described later, and a print processing of a transfer adjustment pattern. That is, the normal print processing mentioned here is a print processing wherein the voltage value as the setting value of the transfer bias which has been read from the memory 42 is applied to the transfer roller 13*a* without being corrected by transfer adjustment described later and thereby transfer of a toner image is performed. Specifically, when the digital composite machine 1 becomes the printable state, the processor 41 of the system controller 4 switches the transfer bias power source circuit 13*b* from the constant current control state to the constant voltage control state. The processor 41 receives print setting such as a kind of a sheet and a print start instruction which have been inputted via the operation panel 5 or the communication device 44 for print processing, and acquires image data for print processing from the scanner 2 or from an external device via the communication device 44 to start print processing. After having started the print processing, the processor 41 controls the sheet feeding roller 32 and the separation roller 33 to take out the sheet selected by the user from the cassette 31, and thereby performs sheet feeding for print processing. Further, the processor 41 controls the conveying device 15 and the resist roller 34 to convey the sheet to the above-described transfer position. In addition, the processor 41 reads the voltage value as the setting value of the transfer bias in accordance with the kind of the sheet inputted via the above-described operation panel 5 and so on, and the humidity detected by the temperature/humidity sensor 62 from the memory 42. The processor 41 controls the transfer bias power source circuit 13*b* so that the transfer bias power source circuit 13*b* outputs the above-described read voltage value as the setting value of the transfer bias, under the constant voltage control. The transfer bias power source circuit 13*b* applies the above-described read voltage value (the setting value of the transfer bias) as the setting value of the transfer bias to the transfer roller 13*a*, in accordance with a timing when the sheet is conveyed to the transfer position (between the photoreceptor drum 12 and the transfer roller 13*a*). The transfer roller 13*a* is applied with the above-described read voltage value as the setting value of the transfer bias to transfer the toner image from the photoreceptor drum 12 to the sheet. Next, a control processing in the case of adjusting the setting value of the transfer bias during the above-described normal print processing will be described in detail. FIG. 3 is a flow chart showing a control processing for adjusting the setting value of the transfer bias in the digital composite machine 1 according to the embodiment. When the power source of the digital composite machine 1 is turned on, the processor 41 of the system controller 4 starts up the respective portions as described above, and switches the transfer bias power source circuit 13*b* to the constant current control state. Next, when the digital composite machine 1 becomes the printable state, the processor 41 becomes a print request waiting state. And when the digital composite machine 1 becomes the printable state, the processor 41 switches the transfer bias power source circuit 13*b* from the constant current control state to the constant voltage control state. And in ACT11 shown in FIG. 3, the processor 41 in the print request waiting state starts a print processing in accordance with a print request from the operation panel 5 or an external device connected to the communication device 44. For example, a user instructs print setting including sheet selection and so on using the operation device 52 of the operation panel 5, and instructs a start of copying or printing. The processor 41 starts the normal print processing with the print setting instructed by the user, as described above. And as described later, in the case of "NO" in ACT12, the processing of the processor 41 transfers to ACT24, and in ACT24 the normal print processing is executed.

That is, when the print processing is started, the processing of the processor 41 of the system controller 4 firstly transfers to ACT12. In ACT12, the processor 41 judges whether or not the voltage value A related to a resistance value of a sheet to be print-processed is measurable, based on the above-described print setting (the kind of the sheet) and image data in accordance with the image to be printed. When toner is not transferred to a prescribed detection range of the sheet to be print-processed, the processor 41 judges that the voltage value A related to the resistance value of the sheet is measureable, and the detector 61 measures the voltage value A. That is, the processor 41 judges whether or not the voltage value A related to the resistance value of the sheet is measurable, based on whether or not toner is transferred to the above-described prescribed detection range of the sheet to be print-processed. For example, the above-described prescribed detection range in a sheet is set to a prescribed range (for example, a range of about 12 mm from a tip or a back end) in a tip portion or a back end portion in the sheet conveying direction. When the toner image is not transferred to the detection range of the sheet, the processor 41 judges that the voltage value A related to the resistance value of the sheet is measurable in the relevant detection range.

When it is judged that the voltage value A related to the resistance value of the sheet is measurable (ACT12, YES), the processing of the processor 41 of the system controller 4 transfers to ACT13. In ACT13, the processor 41 switches the transfer bias power source circuit 13*b* from the constant voltage control state to the constant current control state. And the processor 41 monitors a voltage value of the transfer roller 13*a* to be measured by the detector 61 while the above-described prescribed detection range of the sheet passes through the transfer position. That is, the processor 41 measures a voltage value while the above-described detection range of the sheet passes through the transfer position, using the detector 61. Here, a current value outputted by the transfer bias power source circuit 13*b* under the constant current control is the current value as the setting value of the transfer bias which has been previously stored in the memory 42, in accordance with the kind of the sheet (including the size of the sheet and so on) to be used for print processing. In other words, the processor 41 reads the current value as the above-described setting value of the transfer bias in accordance with the kind of the sheet to be used for print processing from the memory 42.

The transfer bias power source circuit 13*b* outputs the above-described read current value as the setting value of the transfer bias under the constant current control, and applies the current value to the transfer roller 13*a*. When the above-described read current value as the setting value of the transfer bias is applied to the transfer roller 13*a*, the processor 41 of the system controller 4 becomes able to measure the voltage value C indicating the resistance value of the sheet, from Ohm's law and so on, based on the voltage value of the transfer roller 13*a* measured by the detector 61. The detector 61 measures a voltage value at the transfer position, as described above. Actually, the detector 61 measures a voltage value of the transfer roller 13*a*, as the voltage value between the transfer roller 13*a* and the photoreceptor drum 12 at the transfer position.

In this case, if a sheet is present between the transfer roller 13*a* and the photoreceptor drum 12 at the transfer position, a voltage value which the detector 61 measures becomes the voltage value A obtained by adding a voltage value applied to the sheet and a voltage value applied to a member other than the sheet such as the transfer roller 13*a*. In addition, if a sheet is not present at the transfer position, a voltage value which the detector 61 measures becomes the voltage value B applied to the member other than the sheet such as the transfer roller 13*a*. Accordingly, the processor 41 calculates the voltage value C indicating the resistance value of the sheet from a difference (A–B) between the voltage value A measured when the sheet is present at the transfer position and the voltage value B measured when the sheet is not present at the transfer position. In addition, in the embodiment, the voltage value B which has previously and primarily been stored in the memory 42 is used as the voltage value B, as described above, for example.

When the voltage value C indicating the resistance value of the sheet is calculated, the processor 41 of the system controller 4 judges in ACT14 whether the above-described calculated voltage value C (the voltage value indicating the resistance value of the sheet) is a value within the range of the allowable range. The processor 41 refers to the table (information) indicating the allowable range which is stored in the memory 42. The processor 41 judges whether or not the above-described calculated voltage value C is a value outside the range of the allowable range, based on the table stored in the memory 42. In addition, here, a resistance value of a sheet varies depending on humidity, in the above-described table, values indicating allowable ranges for respective humidities are stored. In addition, a resistance value of a sheet varies depending on a kind of a sheet, the memory 42 stores a plurality of the above-described tables in accordance with the kinds of sheets.

Figure 4:
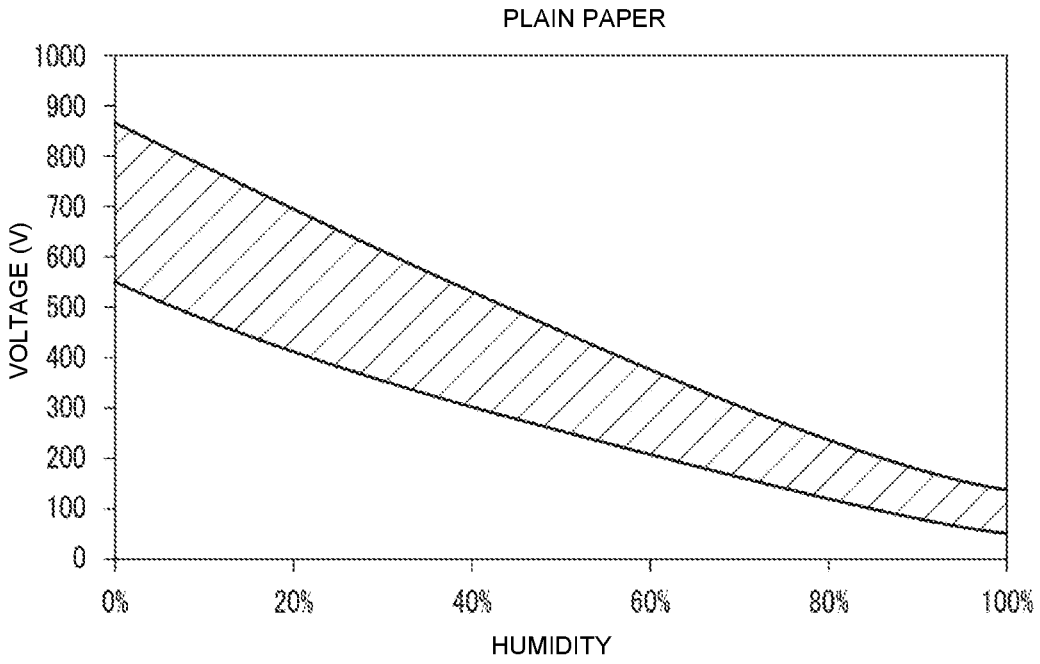
FIG. 4 is a diagram showing an example of an allowable range of a resistance value (voltage value) to a plain paper which the digital composite machine according to the embodiment sets.

FIG. 4 shows an allowable range of a voltage value indicating a resistance value of a sheet in accordance with a humidity in a plain paper of A4 size, for example. The memory 42 stores an upper limit value and a lower limit value of the voltage value in accordance with each humidity shown in FIG. 4, as the table indicating the allowable range of the plain paper of A4 size, for example. By this means, the processor 41 of the system controller 4 judges whether the above-described voltage value C which has been calculated based on the humidity to be detected by the temperature/humidity sensor 62, the voltage value A and the voltage value B which have been measured by the detector 61 is a value within the range of the allowable range. In other words, the processor 41 can judge whether the resistance value of the sheet is a value within the range of the allowable range, based on the humidity to be detected by the temperature/humidity sensor 62 and the above-described calculated voltage value C.

When it is judged that the calculated voltage value C is a value outside the range of the allowable range (ACT14, YES), the processing of the processor 41 of the system controller 4 transfers to ACT15. In ACT15, the processor 41 informs a guide to recommend adjustment of the setting value of the transfer bias (hereinafter referred to also as transfer adjustment). Specifically, the processor 41 displays a message to induce transfer adjustment on the display device 51 of the operation panel 5. In addition, the processor 41 may display a button of a touch panel capable of selecting whether or not the transfer adjustment is to be executed, along with the message to induce transfer adjustment, on the display device 51. By this means, when the voltage value C indicating the resistance value of the sheet becomes a value outside the range of the allowable range, a user oneself can instruct whether or not to perform transfer adjustment. In addition, the processor 41 controls the respective portions (refer to FIG. 2) of the printer 2, in parallel with the processings of the above-described ACT12 to ACT15, to perform print processing and form an image on the sheet. Further, the system controller 4 controls the conveying device 15 and the sheet discharge roller 36 to discharge the sheet formed with the image to the sheet discharge tray 37. The timing when the sheet formed with the image is discharged is a time point of displaying the message in the above-described ACT15, for example. In addition, the sheet at the time of this print processing is a sheet of the kind selected by the user in the above-described ACT11. In addition, the print processing at this time is different from the above-described normal print processing, and the transfer bias power source circuit 13*b* is switched to the constant current control state (refer to the above-described ACT13). Accordingly, the transfer bias power source circuit 13*b* outputs the above-described read current value as the setting value of the transfer bias in accordance with the sheet of the kind selected by the user in the above-described ACT11, under the constant current control, and applies the current value to the transfer roller 13*a*. The user views the message display to recommend the transfer adjustment in the above-described ACT16, and also confirms the image formed on the above-described discharged sheet, and judges whether the transfer adjustment is necessary, and thereby can perform instruction of the above-described transfer adjustment.

Next, in ACT16, the processor 41 of the system controller 4 judges whether or not executing the transfer adjustment is instructed. When it is judged that executing the transfer adjustment is instructed (ACT16, YES), the processing of the processor 41 transfers to ACT17. In ACT17, the processor 41 requests a selection instruction of a kind of the sheet to which the transfer adjustment is performed. For example, the processor 41 displays a guide for making the user select a size and a kind of the sheet on the display device 51. In accordance with the guide like this, the user instructs the size and the kind of the sheet to which the transfer adjustment is performed using the operation device 52. In addition, the user may designate the cassette 31 in which the size and the kind of the sheet is set. In addition, in this case, only one cassette 31 is shown in FIG. 1, but actually, a plurality of the cassettes 31 shall be provided in accordance with sizes and kinds of sheets.

When the user instructs the sheet, the processor 41 of the system controller 4 waits an instruction of starting the transfer adjustment by the user in ACT18. And when having accepted the instruction of starting the transfer adjustment, the processor 41 starts the transfer adjustment. When the transfer adjustment is started, the processor 41 controls the sheet feeding roller 32 and the separation roller 33 to take out the sheet of the kind (refer to ACT17) selected by the user from the cassette 31 to perform sheet feeding for print processing of a transfer adjustment pattern in ACT19. The processor 41 controls the image forming device 20 to form a toner image of the transfer adjustment pattern on the photoreceptor drum 12. Further, the processor 41 controls the conveying device 15 and the resist roller 34 to convey the sheet fed from the cassette 31 to the transfer position. Next, in ACT20, the processor 41 controls the transfer bias power source circuit 13*b* so as to transfer the toner image of the transfer adjustment pattern to the sheet. At this time, the transfer bias power source circuit 13*b* is kept in the constant current control state (refer to the above-described ACT13). The processor 41 reads the current value as the setting value of the transfer bias in accordance with the kind of the sheet to be used in the print processing of the transfer adjustment pattern (the kind of the sheet instructed in ACT17) from the memory 42. The processor 41 controls the transfer bias power source circuit 13*b* so that the transfer bias power source circuit 13*b* outputs the above-described read current value as the setting value of the transfer bias. The transfer bias power source circuit 13*b* outputs the above-described read current value as the setting value of the transfer bias, and applies the read current value to the transfer roller 13*a*. The transfer roller 13*a* transfers the toner image of the transfer adjustment pattern formed by the image forming device 20 from the photoreceptor drum 12 to the sheet.

Figure 5:
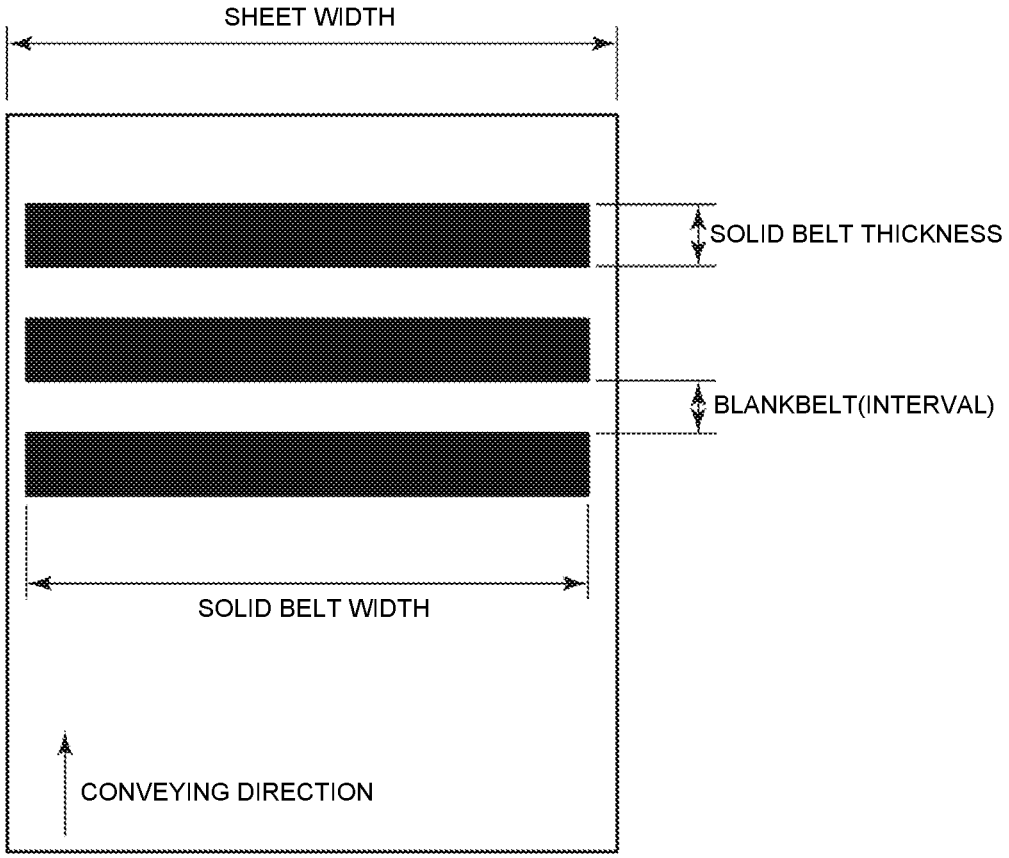
FIG. 5 is a diagram showing a print example of a transfer adjustment pattern which the digital composite machine according to the embodiment forms on a sheet so as to measure the resistance value of the sheet.

Here, the transfer adjustment pattern is a pattern for measuring the voltage values A each related to a resistance value of a sheet in an area to which toner has been transferred in the sheet, and in an area to which toner has not been transferred in the sheet. FIG. 5 shows an example of a sheet to which the transfer adjustment pattern has been transferred. The transfer adjustment pattern shown in FIG. 5 is a prescribed pattern in which a plurality of solid belts (an area with a maximum toner concentration) with a prescribed width (a width of not less than 90% of the width of the sheet, for example) with respect to the width of the sheet to be used are formed at prescribed intervals. For example, a transfer adjustment pattern for a sheet of A4 size with a sheet width of 297 mm may be a pattern in which three solid belts (267 mm×20 mm) are formed at an interval of 20 mm (a blank belt to which toner has not been transferred). The transfer adjustment pattern formed by the image forming device 20 is transferred to the sheet at the transfer position by the transfer roller 13*a* to which the above-described read current value as the setting value of the transfer bias has been applied.

Next, the processor 41 of the system controller 4 monitors voltage values to be measured by the detector 61 when the transfer adjustment pattern is transferred to the sheet in ACT21. That is, the system controller 4 measures the voltage value A related to the resistance value of the sheet to which the transfer adjustment pattern including the blank belt portions and the solid belt portions has been transferred, using the detector 61. In this case, the detector 61 measures the voltage value A of the transfer roller 13*a* when the sheet to which the transfer adjustment pattern has been transferred exists at the transfer position. In addition, since the transfer adjustment pattern includes the blank belt portions and the solid belt portions, the detector 61 measures a voltage value of the blank belt portion of the sheet and a voltage value of the transfer roller 13*a* when the solid belt portion exists at the transfer position.

Next, in ACT22, the processor 41 of the system controller 4 calculates the voltage value C indicating the resistance value of the sheet to which the transfer adjustment pattern has been transferred, and adjusts (corrects) the setting value of the transfer bias so that the voltage value C becomes a value within the range of the above-described allowable range. That is, the processor 41 adjusts (corrects) the setting value of the transfer bias so that the voltage value C is within the allowable range. Here, the voltage value C is a difference between the voltage value A when the sheet to which the transfer adjustment pattern has been transferred exists at the transfer position, and the voltage value B when the sheet does not exist at the transfer position. Specifically, the processor 41 uses a median value of the voltage values measured at the blank belts of the sheet and the voltage values measured at the solid belts of the sheet, as the above-described voltage value A. And the processor 41 corrects the setting value of the transfer bias so that the voltage value C of the difference between the voltage value A (the above-described median value) and the voltage value B when the sheet does not exist at the transfer position is within the above-described allowable range stored in the memory 42 (the allowable range as shown in FIG. 4, for example). More specifically, the processor 41 reads the voltage value as the setting value of the transfer bias in accordance with the kind of the sheet (refer to ACT17) instructed by the user, for example, from the memory 42. The processor 41 corrects the above-described read voltage value as the setting value of the transfer bias, based on a voltage value of the difference between the voltage value A of the above-described median value and the upper limit value or the lower limit value of the above-described allowable range. By this means, it is possible to adjust the setting value of the transfer bias in accordance with the resistance value of the sheet according to the instruction of the user. In addition, the processor 41 primarily stores the above-described corrected voltage value as the setting value of the transfer bias in the memory 42, for the print processing described later.

When the transfer adjustment is completed, the processor 41 of the system controller 4 informs the adjustment completion, and finishes the transfer adjustment in ACT23. For example, the processor 4 displays a guide indicating that the transfer adjustment has been finished on the display device 51 of the operation panel 5. In addition, when the above-described transfer adjustment is finished, the processor 41 controls the conveying device 15 and the sheet discharge roller 36 to discharge the sheet formed with the transfer adjustment pattern to the sheet discharge tray 37. The timing when the sheet formed with the transfer adjustment pattern is discharged is a time point of informing the adjustment completion in the above-described ACT23, for example. In addition, when the transfer adjustment is finished, the processor 41 continues to execute the print processing using the above-described adjusted voltage value as the setting value of the transfer bias in ACT24. That is, the processor 41 controls the sheet feeding roller 32 and the separation roller 33 to take out the sheet (the sheet designated in ACT17, for example) of the kind selected by the user from the cassette 31 to perform sheet feeding for print processing of the image in accordance with the above-described image data. Further, the processor 41 controls the image forming device 20 to form a toner image in accordance with the above-described image data on the photoreceptor drum 12. Further, the processor 4 controls the conveying device 15 and the resist roller 34 to convey the sheet fed from the cassette 31 to the transfer position. In addition, the processor 41 switches the transfer bias power source circuit 13*b* from the constant current control state to the constant voltage control state. The processor 41 reads the voltage value as the setting value of the transfer bias which has been adjusted as described above and has been primarily stored in the memory 42, from the above-described memory 42. The processor 41 controls the transfer bias power source circuit 13*b* so that the transfer bias power source circuit 13*b* outputs the above-described adjusted voltage value as the setting value of the transfer bias. The transfer bias power source circuit 13*b* outputs the above-described adjusted voltage value as the setting value of the transfer bias under the constant voltage control, and applies the adjusted voltage value to the transfer roller 13*a*. The transfer roller 13*a* is applied with the above-described adjusted voltage value as the setting value of the transfer bias to transfer the toner image from the photoreceptor drum 12 to the sheet. On the other hand, when it is judged in the above-described ACT12 that the resistance value (voltage value) of the sheet is not measurable (ACT12, NO), the processing of the processor 41 transfers from the above-described ACT12 to ACT24. In ACT24 of this case, the processor 41 starts the normal print processing of the image data acquired from the scanner 3 or from an external device connected to the communication device 44 with the user's print setting (the print setting instructed by the user in ACT11, for example) as described above. In addition, when it is judged, in the above-described ACT14, that the voltage value C indicating the resistance value of the sheet is a value within the range of the allowable range (ACT14, NO), the processing of the processor 41 transfers from the above-described ACT14 to ACT24. In this case, the transfer roller 13*a* is at a timing when the transfer roller 13*a* has been applied with the above-described current value as the setting value of the transfer bias, and has completed the transfer of the toner image. Accordingly, in ACT24 of this case, the processor 41 controls the fixing device 14 so that the transferred toner image is fixed to the sheet, so as to continue the print processing. Further, the processor 41 controls the conveying device 15 and the sheet discharge roller 36 so that the sheet formed with the toner image is discharged to the sheet discharge tray 37. Further, when it is judged in the above-described ACT16 that there is no instruction of the transfer adjustment by a user (ACT16, NO), the processing of the processor 41 transfers from the above-described ACT16 to ACT24. Also in this case, the transfer roller 13*a* is at a timing when the transfer roller 13*a* has been applied with the above-described current value as the setting value of the transfer bias, and has completed the transfer of the toner image. Accordingly, in ACT24 of this case, the processor 41 controls the fixing device 14 so that the transferred toner image is fixed to the sheet, so as to continue the print processing. Further, the processor 41 controls the conveying device 15 and the sheet discharge roller 36 so that the sheet formed with the toner image is discharged to the sheet discharge tray 37. In addition, when the processing of the processor 41 has transferred from the above-described ACT14 to ACT24 and has transferred from the above-described ACT16 to ACT24, the processor 41 may anew switch the transfer bias power source circuit 13*b* from the constant current control state to the constant voltage control state to execute the above-described normal print processing.

In addition, in the above-described embodiment, when there is a guide to recommend adjustment of the setting value of the transfer bias during printing, a user can instruct execution of the adjustment of the transfer bias. However, a user may instruct execution of the above-described adjustment of the transfer bias at an optional timing. For example, when the digital composite machine 1 is waiting, a user can instruct execution of the adjustment of the setting value of the transfer bias, via the operation device 52 of the operation panel 5. When it is possible to execute adjustment of the setting value of the transfer bias at an optional timing, the processor 41 of the system controller 4 may perform the processings of the above-described ACT17-ACT23 in accordance with a user's instruction.

As described above, in the case in which the toner image is not transferred to the prescribed detection range of a sheet to be print-processed, when the relevant detection range passes through the transfer position, the image forming apparatus according to the embodiment monitors the voltage value (the voltage value A related to the resistance value of the sheet) in the transfer member (transfer roller), in the state in which the transfer bias power source circuit is switched to the constant current control. If the voltage value C to be calculated based on the voltage value A which has been monitored in the above-described constant current control state, in consideration of the information of the machine body use environment such as the humidity, is a value outside the range of the allowable range, the image forming apparatus according to the embodiment performs a guide to recommend adjustment of the setting value of the transfer bias. By this means, according to the embodiment, when the setting value of the transfer bias in accordance with the kind of a sheet to be actually used in print processing is not a value of the transfer bias suitable for the actual machine body use environment, it is possible to induce a user to adjust the setting value of the transfer bias.

In addition, when adjustment of the setting value of the transfer bias is instructed by the user, the image forming apparatus according to the embodiment monitors the voltage value of the transfer member (transfer roller), while transferring the toner image of the prescribed transfer adjustment pattern to a sheet, in the state in which the transfer bias power source circuit is switched to the constant current control. The image forming apparatus according to the embodiment corrects the setting value of the transfer bias, based on the voltage value indicating the resistance value of the sheet to which the transfer adjustment pattern has been transferred. By this means, it is possible to correct the setting value of the transfer bias in accordance with the sheet, in consideration of the resistance values of the relevant sheet in an area to which the toner image has been transferred and in area to which the toner image has not transferred.

According to the image forming apparatus of the embodiment, the setting value of the transfer bias is corrected in accordance with the user's instruction, and thereby it is possible to properly correct the setting value of the transfer bias even when a sheet with high resistance and a sheet with low resistance are used in print processing.

As this result, the image forming apparatus of the embodiment can prevent transfer defect against sheets of various kinds, namely sheets with various resistances, and thereby it is possible to maintain good image for each sheet to be used by the user.

In addition, in the above-described embodiment, the digital composite machine as the image forming apparatus has the configuration in which the toner image is directly transferred from the photoreceptor drum to a sheet. But the above-described embodiment is not limited to this, and can be applied to an image forming apparatus which transfers the toner image formed on the photoreceptor drum to a sheet via a transfer belt as an intermediate transfer body. In addition, the image forming apparatus of the above-described embodiment has only one image forming device to form the toner image, but may have a plurality of the image forming devices. For example, the above-described embodiment can be applied to a color printer having a plurality of image forming devices which form toner images with toners of respective colors composing a color.

While certain embodiments have been described, these embodiments have been presented by way of example only, and are not intended to limit the scope of the inventions. Indeed, the novel embodiments described herein may be embodied in a variety of other forms; further, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus which transfers a toner image to a sheet to form an image on a sheet of every kind, the image forming apparatus comprising:

an image carrier to hold the toner image to be transferred to the sheet;

a transfer member provided opposite to the image carrier at a prescribed transfer position which is applied with a transfer bias in accordance with a kind of the sheet to transfer the toner image from the image carrier to the sheet passing through the transfer position;

a transfer bias power source circuit to apply the transfer bias for transferring the toner image from the image carrier to the sheet to the transfer member;

a detector to measure a voltage value or a current value in the transfer member so as to calculate a value indicating a resistance value of the sheet passing through the transfer position;

a memory to store information of an allowable range of the value indicating the resistance value of the sheet to be calculated based on a measurement value by the detector;

a display to display a message to recommend adjustment of the transfer bias to be applied to the transfer member by the transfer bias power source circuit; and a processor configured to:

calculate the value indicating the resistance value of the sheet based on the measurement value by the detector, judge whether or not the calculated value indicating the resistance value of the sheet is a value outside a range of the allowable range stored in the memory, and make the display display the message when the calculated value indicating the resistance value of the sheet is the value outside the range of the allowable range stored in the memory.

2. The image forming apparatus according to claim 1, wherein:

the detector is a voltage detector to measure the voltage value in the transfer member; and the processor calculates the voltage value indicating the resistance value of the sheet, based on a measurement value by the detector when the sheet passes through the transfer position and a measurement value by the detector when the sheet does not pass through the transfer position.

3. The image forming apparatus according to claim 2, further comprising:

an image forming device to form the toner image in accordance with image data on the image carrier, wherein the processor is further configured to:

judge whether or not the toner image is transferred in a prescribed detection range in the sheet, based on the image data, calculate the voltage value indicating the resistance value of the sheet when the toner image is not transferred in the prescribed detection range, and make the display display the message when the calculated voltage value is a voltage value outside the range of the allowable range stored in the memory.

4. The image forming apparatus according to claim 3, wherein:

the transfer bias power source circuit outputs, as the transfer bias, a transfer bias of a current value in accordance with the kind of the sheet under constant current control, and outputs a transfer bias of a voltage value in accordance with the kind of the sheet under constant voltage control; and the processor switches the transfer bias power source circuit to a state of the constant current control when the toner image in accordance with the image data is not transferred in the prescribed detection range.

5. The image forming apparatus according to claim 1, further comprising:

a humidity sensor, wherein the memory stores information of the allowable range in accordance with a humidity; and the processor is further configured to:

refer to the allowable range stored in the memory, based on a detection result by the humidity sensor, and judge whether or not the calculated value indicating the resistance value of the sheet is a value outside the range of the referred allowable range.

6. An image forming apparatus which transfers a toner image to a sheet to form an image on a sheet of every kind, the image forming apparatus comprising:

an image forming device to form the toner image in accordance with image data on an image carrier;

a transfer member provided opposite to the image carrier at a prescribed transfer position which is applied with a transfer bias in accordance with a kind of the sheet to transfer the toner image from the image carrier to the sheet passing through the transfer position;

a transfer bias power source circuit to apply the transfer bias for transferring the toner image from the image carrier to the sheet to the transfer member;

a detector to measure a voltage value or a current value in the transfer member so as to calculate a value indicating a resistance value of the sheet passing through the transfer position; and a processor configured to:

control the image forming device so as to form a toner image of a prescribed transfer adjustment pattern on the image carrier, control the transfer bias power source circuit so that the transfer bias in accordance with the kind of the sheet to which the toner image of the transfer adjustment pattern is to be transferred is applied to the transfer member, and the toner image of the transfer adjustment pattern is transferred to the sheet, calculate a value indicating a resistance value of the sheet to which the toner image of the transfer adjustment pattern has been transferred, based on a measurement value by the detector when the toner image of the transfer adjustment pattern is transferred to the sheet, and adjust the transfer bias to be applied to the transfer member by the transfer bias power source circuit, based on the calculated value indicating the resistance value of the sheet.

7. The image forming apparatus according to claim 6, wherein:

the detector is a voltage detector to measure the voltage value in the transfer member; and the processor calculates the voltage value indicating the resistance value of the sheet, based on a measurement value by the detector when the sheet to which the toner image of the transfer adjustment pattern is to be transferred passes through the transfer position and a measurement value by the detector when the sheet does not pass through the transfer position.

8. The image forming apparatus according to claim 7, wherein:

the transfer bias power source circuit, as the transfer bias, outputs a transfer bias of a current value in accordance with the kind of the sheet under constant current control, and outputs a transfer bias of a voltage value in accordance with the kind of the sheet under constant voltage control; and the processor switches the transfer bias power source circuit to a state of the constant current control when the toner image of the transfer adjustment pattern is transferred to the sheet so as to adjust the transfer bias.

9. The image forming apparatus according to claim 8, further comprising:

a memory to store information of an allowable range of the voltage value indicating the resistance value of the sheet to be calculated based on the measurement value by the detector, wherein the processor is further configured to:

judge whether or not the calculated voltage value is a voltage value outside a range of the allowable range stored in the memory, and adjust the transfer bias to be applied to the transfer member by the transfer bias power source circuit, based on a difference between the calculated voltage value and an upper limit value or a lower limit value of the allowable range stored in the memory.

10. The image forming apparatus according to claim 6, further comprising:

an operation panel to accept the kind of the sheet to which the toner image of the transfer adjustment pattern is transferred, and a start instruction of adjustment of the transfer bias, wherein when the start instruction of the adjustment of the transfer bias is accepted by the operation panel, the processor controls the transfer bias power source circuit so that the transfer bias in accordance with the kind of the sheet accepted by the operation panel is applied to the transfer member, and the toner image of the transfer adjustment pattern is transferred to the sheet.

* * * * *